US005331787A

United States Patent [19]

Paulitschke et al.

[11] Patent Number: 5,331,787

[45] Date of Patent: Jul. 26, 1994

[54] METHOD FOR THERMALLY AND/OR ACOUSTICALLY INSULATING BUILDINGS

[75] Inventors: Werner Paulitschke, Kaarst; Karl Rudolph, Bottrop, both of Fed. Rep. of Germany

[73] Assignee: Deutsche Rockwool Mineralwoll-GmbH, Fed. Rep. of Germany

[21] Appl. No.: 859,498

[22] PCT Filed: Nov. 17, 1990

[86] PCT No.: PCT/EP90/01968

§ 371 Date: Jun. 15, 1992

§ 102(e) Date: Jun. 15, 1992

[87] PCT Pub. No.: WO91/09184

PCT Pub. Date: Jun. 27, 1991

[30] Foreign Application Priority Data

Dec. 14, 1989 [DE] Fed. Rep. of Germany ..... 3941273

[51] Int. Cl.[5] ..... E04G 21/00

[52] U.S. Cl. ..... 52/746; 52/406.1; 206/321; 206/410; 206/497; 428/74

[58] Field of Search ..... 52/406, 407, 746; 206/389, 410, 497, 321; 428/74

[56] References Cited

U.S. PATENT DOCUMENTS

| | | | |
|---|---|---|---|
| 1,894,592 | 1/1933 | Kilmer | 52/407 |
| 2,159,053 | 5/1939 | Saborsky | 52/406 |
| 2,354,186 | 7/1944 | Donahue | 206/321 |
| 2,913,104 | 11/1959 | Parker | 206/321 |
| 3,121,649 | 2/1964 | Oliver | 52/746 |
| 3,140,220 | 7/1964 | Walter . | |
| 3,222,243 | 12/1965 | Gaston et al. . | |
| 3,231,085 | 1/1966 | Flores et al. | 206/321 |
| 4,569,174 | 2/1986 | Bossany | 52/406 |
| 4,709,523 | 12/1987 | Broderick et al. | 52/406 |
| 4,952,441 | 8/1990 | Bose et al. | 52/406 X |
| 4,972,644 | 11/1990 | Rumiesz, Jr. et al. | 52/406 |
| 5,150,647 | 9/1992 | Mohr | 83/93 X |

FOREIGN PATENT DOCUMENTS

| | | | |
|---|---|---|---|
| 564293 | 10/1958 | Canada | 52/406 |
| 0067088 | 12/1982 | European Pat. Off. . | |
| 2216371 | 10/1972 | Fed. Rep. of Germany . | |
| 3229601 | 2/1984 | Fed. Rep. of Germany . | |

*Primary Examiner*—Lloyd A. Gall
*Attorney, Agent, or Firm*—Diller, Ramik & Wight

[57] ABSTRACT

A method of insulating buildings which include a plurality of support members with adjacent support members being spaced a predetermined maximum distance from each other. A plurality of stacked insulation panels (or an insulation roll) is provided with each insulation panel being formed by a panel of mineral wool insulation material having opposite longitudinal edges spaced a predetermined distance from each other at least equal to the predetermined maximum distance between the adjacent support members. A vapour barrier sheet is carried by each insulation material panel (or an insulation roll) with opposite longitudinal edges being folded upon an exterior surface of a central portion of each vapour barrier sheet and being directed in opposing relationship toward each other thereby defining exposed opposite projecting longitudinal edge portions of each insulation material panel with the folded distance being sufficient for the subsequently unfolded vapour barrier sheet longitudinal edges to project beyond the insulation material panel longitudinal edges. The stacked insulation panels are enclosed in a wrap. Thereafter the wrap and at least one of the longitudinal edge portions of all of the insulation material panels (or insulation roll) is substantially simultaneously longitudinally severed inward of each of their longitudinal edges a distance which creates a severed edge-to-edge distance corresponding generally to a distance between adjacent support members less than the predetermined maximum distance.

22 Claims, 3 Drawing Sheets

METHOD FOR THERMALLY AND/OR ACOUSTICALLY INSULATING BUILDINGS

BACKGROUND OF THE INVENTION

The invention concerns a method for thermally and/or acoustically insulating buildings, in particular building roofs and outer walls, by inserting webs, i.e., strips, or sheets, i.e. panels of mineral wool, in particular rockwool, between such abutments, beams, studs or rafters, and a foil acting as a vapor guard or barrier being bonded or laminated to one side of the strips or panels, the free longitudinal edge bands of said foil being folded once or more often inward so that at least one longitudinal edge of the strips or panels projects outward beyond the particular folded edge band of the vapor barrier. The strips are wound into a roll or the panels are stacked on each other into packaged units.

DESCRIPTION OF THE PRIOR ART

A technique of the above kind is known from the German patent 31 36 935. However this state of the art involves making the strips or panels from superposed layers and to so mount these layers that they run at angles in a range from 10° to 60°, preferably 15° to 45° relative to the plane of the strip or panel. The mineral fibers inside the layers being essentially parallel to the layer surfaces, this angular range also applies to the mineral fibers inside the strips or panels. As a result both the compressibility and the elasticity are increased when there is pressure on the side zones and the large surfaces of the strips or the panels. When being inserted between two beams, the strip or panel can be deformed by compressing the side zones to some extent in such manner that on account of its elasticity and compressibility, it will be self-retaining. In this manner and within a small range, compensation therefore may take place when the spacing between beams varies. This state of the art does not call for cutting the side edges of the strip or panels. The bonded or laminated vapor barrier is folded once or more often at the free longitudinal edges. The sole purpose of this feature is to prevent the vapor barrier from hampering the compression of the strip or panels being inserted between the beams, namely in relation to a further state of the art wherein the vapor barrier is bonded over its entire surface and projects by both side edges. A foil of kraft paper is bonded to these projecting side edges and encloses the two side edges of the strip or panel and the back side away from the vapor barrier. In this case the kraft paper prevents compression. Moreover there would be corrugations or folds in the vapor barrier.

The German patent 32 29 601 discloses another state of the art wherein a lamination strip is so deposited on an insulating layer of mineral-fiber felt that the edge zone of the insulating layer is exposed with removable edge bands. Optical marking lines are present so that edge bands along the marking lines can be cut off at the work site to match the requirements of the particular installation. However the insulation strip first must be spread into a plane, that is, if the strip was previously rolled up, it now must be unwound. In order not to damage the laminated strip projecting at the edges by edge zones, a cutting accessory in the form of a cut-resistant plane or board must be inserted between the lamination strip and the insulating layer. As the strips as a rule are very long, it is difficult to insert the plate over such a length and moreover cutting is difficult and time-consuming in spite of the marking lines.

Moreover an insulator is known from the German Offenlegungsschrift 22 16 371 which consists of a continuous elastic mat formed from bound fibers and with longitudinal edges. A cover layer is deposited by means of an adhesive on the mat, and this cover layer is either inwardly folded at the edge or reinforced by an edge band so that bonding of the cover layer is prevented in the vicinity of the edge strip. The edge strip is separated in manufacture, however, it is wound together with the mat to protect the sideways projecting edge strip of the cover layer. Following moving or shipping to the work site, the roll is unwound into a planar strip. Thereupon the edge strip can be removed. The width of the edge strip may be selected at the factory, however at the work site, matching the mat to different spacings between the rafters is possible only with great exertions.

Another state of the art is known from the European patent 0 067 088, wherein again an insulating strip with bonded lamination is provided, said lamination projecting by edge bands from the longitudinal sides. Segmented edge bands are present at the two longitudinal edges and also are bonded by adhesive to the lamination. The edge bands may be of different widths along the two longitudinal edges, so that they can be taken off selectively for the purpose of matching the insulator strip to different installation widths. When the edge bands are taken off, one must expect that mineral fibers parts more or less thick shall stick to the layer of adhesive and will require being removed in a cumbersome manner or one must proceed in less than a neat manner. In any event matching the insulator strip to the particular installation width is possible only to the extent the fabricated width of the edge bands so allows.

Lastly a state of the art known from the German Gebrauchsmuster 78 30 852 must be mentioned, which comprises a planar thermal insulator with a metal vapor barrier that is bonded over the surface in such a way that insulator ribs present on both longitudinal sides are left unbonded. The insulator ribs may be broken off individually in order to match different installation widths. The vapor barrier foil projects from the edges and may be reinforced by needle-proof roof strips. The lateral overlaps also may be self-adhesive so that the self-adhesive layers are used for needle-free assembly until the counter-laths are mounted. It is a complex and labor-intensive procedure to manufacture the numerous insulator ribs at the edges. Because the insulator ribs do not take part in the bonding, handling at the work site and during installation is unreliable.

SUMMARY OF THE INVENTION

Accordingly, it is the object of the invention to create a method for thermally and/or acoustically insulating buildings so as to permit easy matching the strips or panels to the most diverse installation widths and further facilitating both the previous manufacture and installation handling.

The invention solves this problem in that, in order to match any distance between two beams, a portion of the protrusion of the longitudinal edge, of which the width is selected to be at least as large as the maximum difference between the various distances between beams, shall be directly severed from the packed unit.

The invention furthermore concerns a strip or panels made of mineral wool, in particular rockwool, for the thermal and/or acoustical insulation of buildings, especially building roofs and outside walls, to be inserted between beams such as rafters, a vapor barrier in the form of a foil being bonded or laminated on one side and the free longitudinal edge bands being folded inward once or several times as a result of which at least one longitudinal edge of the strip or the panels projects outward above the particular, folded edge band of the vapor barrier, the strip being formed into a roll, or the panels being formed into a stack, as packaged units.

The strip or the panels are characterized in that the width of the projection of the longitudinal edge is at least as large as the biggest difference between the various spacings of the beams and in that in order to match any spacing encountered (installation width) between two beams, a portion of the surplus can be directly severed off the packaged unit.

BRIEF DESCRIPTION OF THE DRAWINGS

The drawing shows schematic and illustrative embodiment modes of the invention.

DESCRIPTION OF THE PREFERRED EMBODIMENTS

Figure 1:
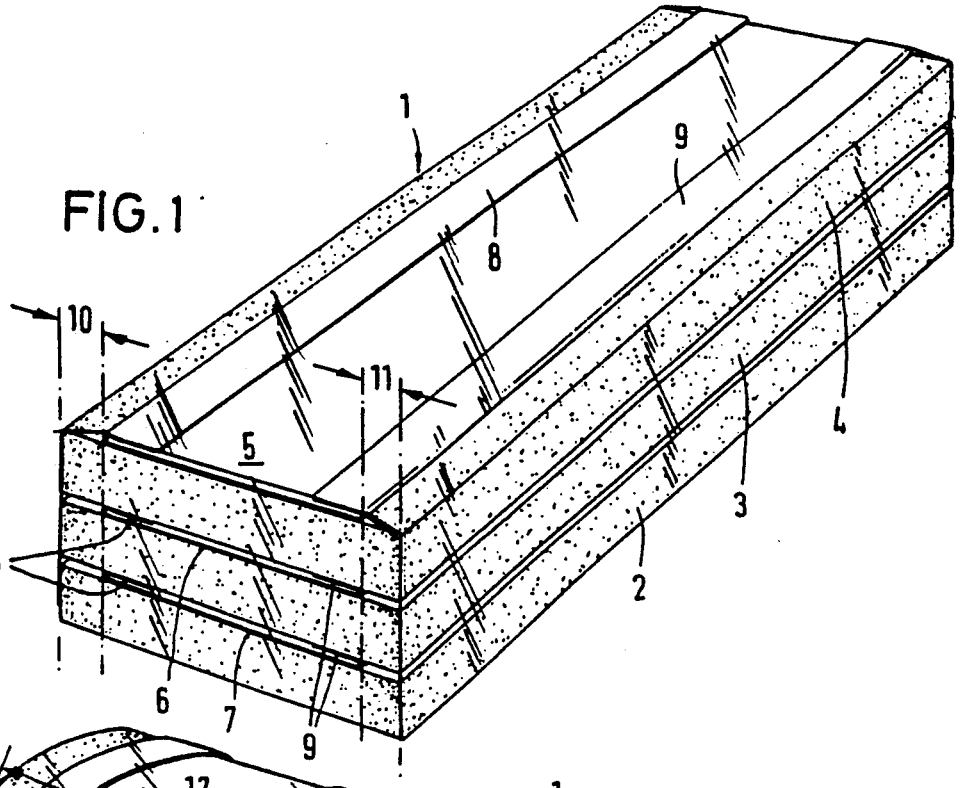
FIG. 1 is a perspective of a packaged unit of panels.

FIG. 1 is a perspective view of an illustrative embodiment of packaged unit 1 consisting of three superposed panels 2, 3, 4 made of mineral wool, in particular rockwool. For the sake of simplicity only three panels are shown. Practically such packaged units consist of a substantially larger number of panels. Each panel is provided on one side, in the present embodiment mode on the top side, with a vapor barrier 5, 6, 7, and this vapor barrier is in the form of a foil bonded or laminated to the panel. Advantageously each vapor-barrier 5, 6 and 7 consists of mutually bonded foils of aluminum and kraft paper. In an alternative, the vapor barrier also may advantageously consist of mutually bonded aluminum and netted plastic foils. The free unbonded or unlaminated longitudinal edge bands 8 and 9 of the vapour barrier are folded inward once or several times, in a manner further discussed below, as a result of which at least one longitudinal edge of the panels projects outward beyond the particular, folded longitudinal edge bands 8, 9 of the vapor barrier. In this embodiment mode the two projections are denoted by 10 and 11. The total packaged unit 1 may be clad by a foil, preferably a plastic shrink-wrap, as a result of which foremost also the two lateral panel projections 10, 11 are protected in storage and shipping.

Figure 2:
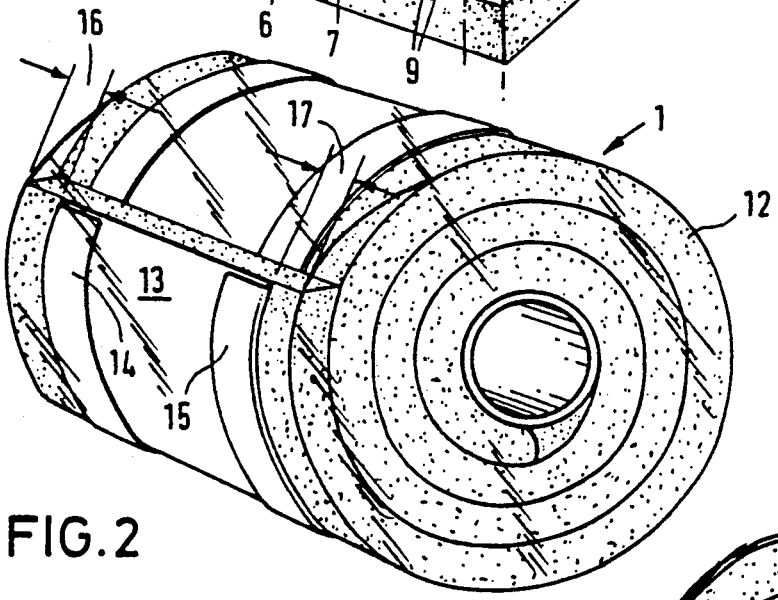
FIG. 2 is a perspective of a packaged unit of a rolled up strip.
Figure 3:
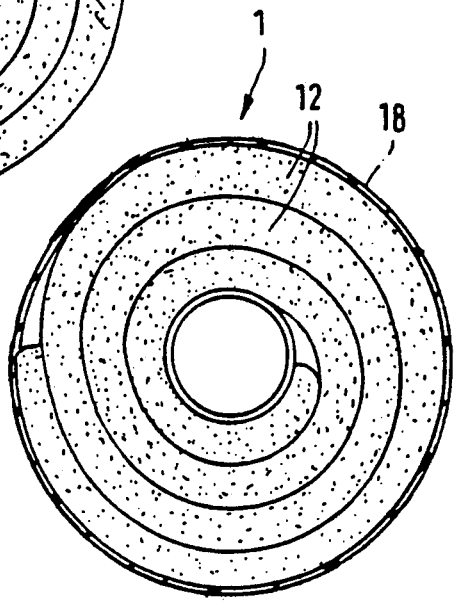
FIG. 3 is an end view of another embodiment of a packaged unit in roll form.

FIGS. 2 and 3 illustrate other embodiments of a packaged unit 1 which in this case consists of a single, flexible strip 12, again made of mineral wool, in particular rockwool, wound into a roll. Again a vapor barrier 13 is bonded or laminated onto one side, preferably the outer side of the strip, and its longitudinal edge bands 14 and 15 are folded inward once or more often, so that according to the above discussion relating to FIG. 1, again projections 16, 17 are created. Again as for the case of FIG. 1, the packaged unit 1 assuming the form of a roll is clad by a foil 18, preferably a shrink wrap (FIG. 3).

Figure 4:
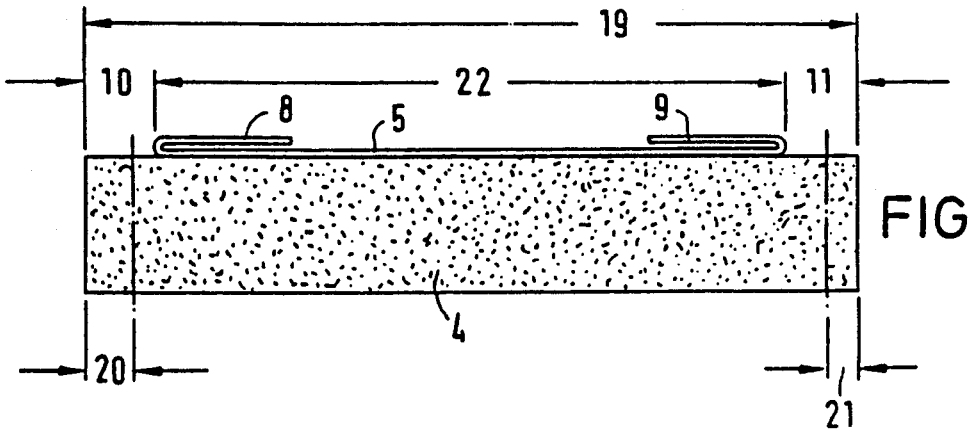
FIG. 4 is an end view of the uppermost panel of the panel unit of FIG. 1.

For the sake of simplicity and clarity, FIG. 4 shows an end face only of a single panel 4 taking the place of the entire package of a stack of panels, i.e. the packed contents 1 of FIG. 1. Rigorously considered, therefore, FIG. 4 must be considered a stack of panels. This also applies to the further embodiment modes of FIGS. 5 and 10.

The width 19 of the panel 4 and, as already discussed, of the entire stack of panels, is so chosen that it is equal to or larger than the maximum inside width 40 between two beams 27 and 28, for instance two rafters. This is shown by FIG. 6.

In the embodiment mode of FIG. 4, the vapor barrier 5 is laminated or suitably bonded only to the central longitudinal zone of the panel 4, namely perpendicularly to the plane of the Figure and symmetrically to the longitudinal direction of this panel, across the width 22. In this way, equal-width projections 10 and 11 are created on both sides. The two longitudinal edge bands 8 and 9 are only folded inward once in this embodiment mode. The width of these bands is selected in such a way that following unfolding outward, they shall at least partly project outward beyond the projections 10 and 11.

Figure 6:
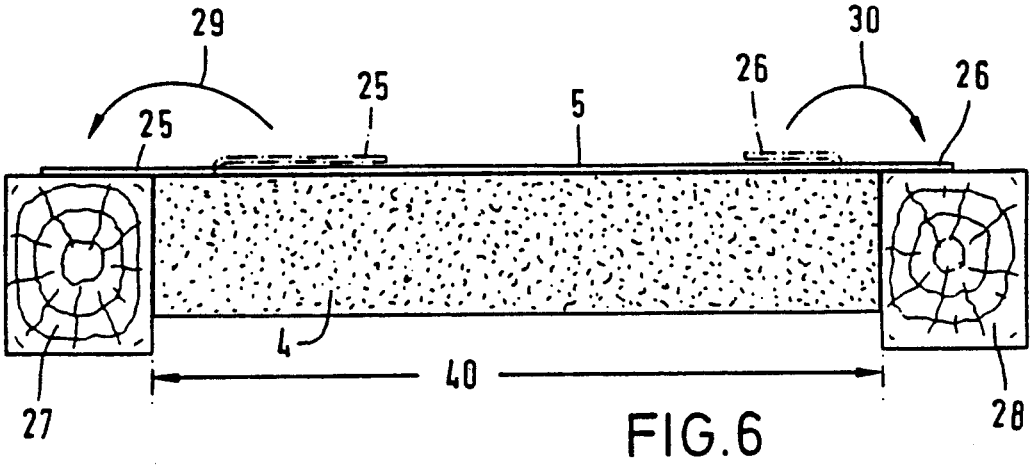
FIG. 6 is an end view of the panel of FIG. 5 following separation of the longitudinal edge of the surplus and following opening of the packaged unit, in the installed state of the panel between the beams.

It is of substantial significance now that the width of the projection 10 or 11 or of both considered together be selected to be at least as large as the maximum difference between the various spacings between the beams 27, 28 (FIG. 6). The packaged units 1 are delivered in one width 19 to the work site. Next the workman measures the inside width 40 between two beams 27 and 28. If for instance building roofs must be thermally insulated, then the inside width between rafters may vary so much that the panels or strip no longer can be installed by being merely compressed from the sides. Here the invention offers the essential advantage that by once severing either or both projections, namely cutting through the entire packaged unit, the desired width of all panels of this packaged unit or of the strip packaged as a roll, i.e. the desired installation width shall be available. The work is made much simpler thereby and most of all there is accurate cutting. FIG. 4 shows that accordingly, to match any spacing 40, i.e., any installation width between two beams, a part 20 and/or 21 of the projection can be directly severed off the packaged unit 1. Preferably a slight excess width, in particular 2 cm, shall be left, because the panels or strip used in practice are easily compressed by this amount when pressure is applied to the side edges, as a result of which the panels or strip tightly lie against the beams. Following the single cutting of one, or where called for both, projection(s) of the entire packaged unit 1, this packaged unit is laid out into individual panels or the packaged unit present as a roll is unwound, so that the individual panels or the strip now in the final-cut width can be installed between the beams.

Figure 5:
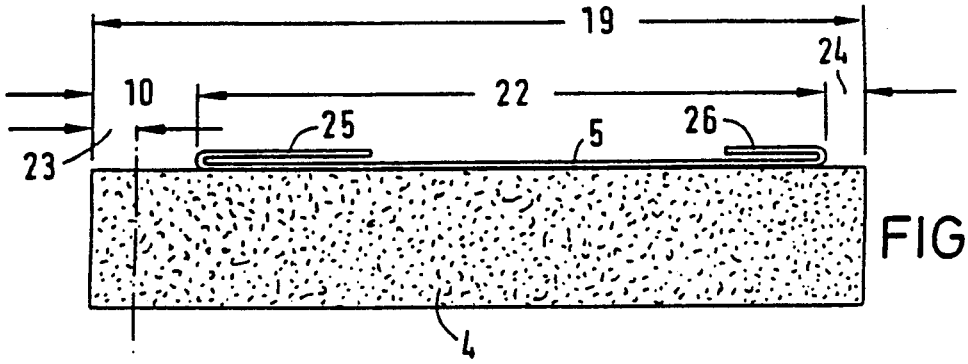
FIG. 5 is an end view according to FIG. 4 for another embodiment.

FIG. 5 shows an embodiment mode which is covered by the above discussion relating to FIG. 4, however in this case the vapor barrier is bonded or laminated asymmetrically to the longitudinal direction of the strip or panels. The left projection 10 is very wide, whereas the right projection 24 is very narrow and where called for may be absent entirely. This advantageous embodiment offers large variations in the width 23 of the portion of the projection which can be severed by one cut from the packaged unit 1. In this embodiment of asymmetrically deposited vapor barrier 5, the longitudinal edge bands 25 and 26 also evince different widths, as shown by FIG. 5, namely the band 25 is substantially broader than the band 26. In an advantageous design, and with an asymmetrically bonded or laminated vapor barrier 5, the longitudinal band 26 is folded once and the longitudinal edge band 25 is folded twice or more often.

It was found practically advantageous to make the width of the partly severable projection 20 and/or 21 or 23 at least 100 mm.

FIG. 6 shows a panel 4, after the packaged unit was cut as a whole, in the installed state between two beams 27, 28. As soon as the panel has been inserted, the longitudinal edge bands 25 and 26 of the vapor barrier 5 are tipped over outward in the direction of the arrows 29 and 30, respectively, and are affixed in conventional manner to the beams, for instance by stapling to the rafters. It is clear per se that when thermally insulating slant roofs, the particular panels 4 or the strip shall be installed from below. If shown in a drawing, the vapor barrier 5 would be laid against the underside of the beams 27, 28. The panel 4 or the strips then would also be flush with the undersides of the beams. A venting gap at least 2 cm deep will then be located on the outside of the panel or strip.

Figure 7:
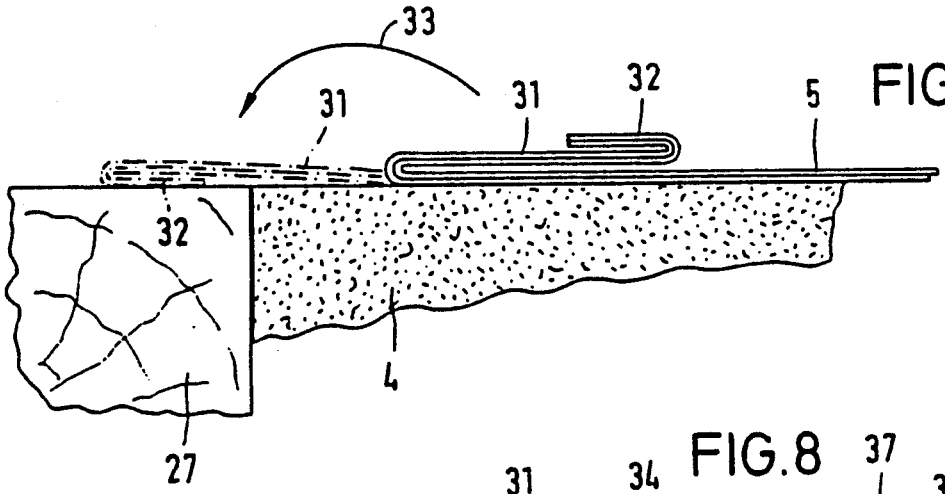
FIG. 7 is a partial view corresponding to FIG. 6 for another embodiment mode.

FIG. 7 shows an embodiment mode in which the vapor barrier 5 comprises two longitudinal edge bands with two folding parts 31 and 32. When unfolding in the direction of the arrow 33, the second fold 32 is preserved and in this manner a reinforced edge is achieved.

Figure 8:
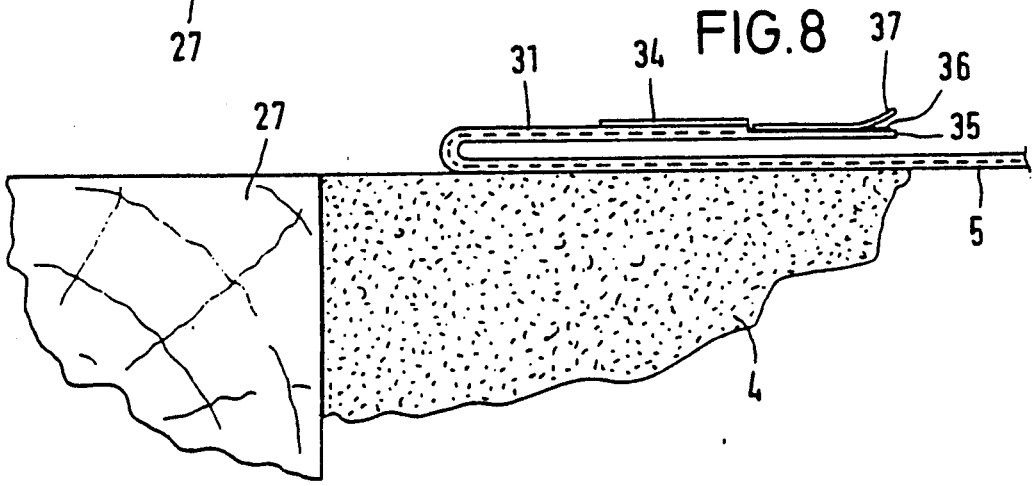
FIG. 8 is a partial view according to FIG. 7 again in another embodiment mode.
Figure 9:
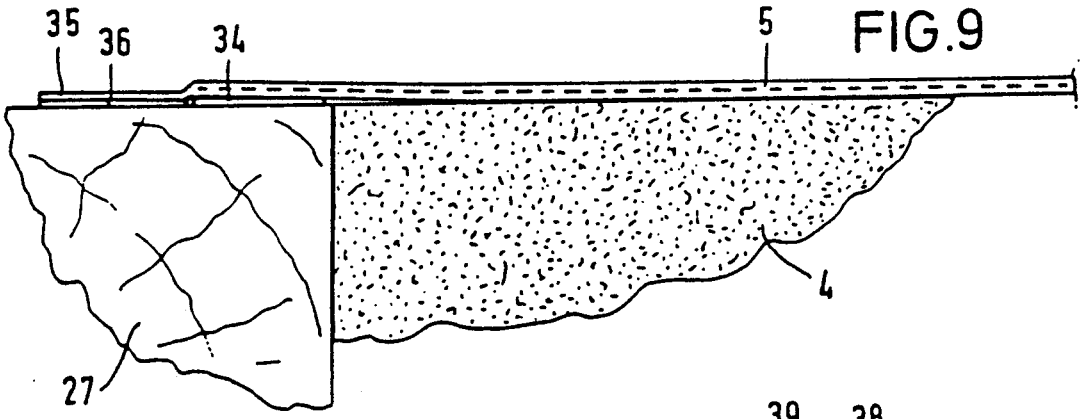
FIG. 9 is a partial view corresponding to FIG. 8 but in the finished installed state.

FIG. 8 shows another kind of reinforcement of the longitudinal edge band. In this case a special reinforcing band 34 is bonded onto the folded part 31. Moreover and advantageously an extension band 35 may be provided, which is fitted with a coating of adhesive or an adhesive tape 36. The adhesive tape 36 may be covered by a removable cover foil 37. After removing the cover foil and unfolding the longitudinal edge band of the vapor barrier, the embodiment shown by FIG. 9 is achieved, the adhesive tape adhering to the beam 27 and the reinforcing band 34 serving to facilitate fastening.

Figure 10:
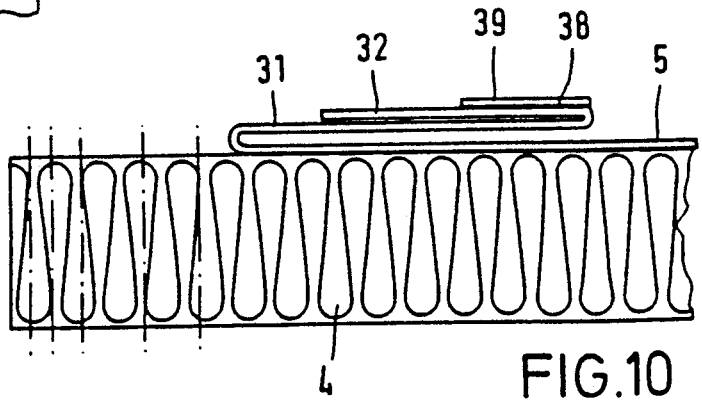
FIG. 10 is a partial view in relation to FIG. 5 however again for another embodiment mode.

FIG. 10 shows another embodiment, in which the longitudinal edge band of the vapor barrier 5 again comprises a double fold 31 and 32 similar to that of FIG. 7. In this case an adhesive tape 38 is mounted near the fold edge between the two parts 31 and 32 and is covered by a cover foil 39. The cover foil 39 may be pulled off as desired.

The above discussion made it amply plain that the packaged units 1 advantageously shall be clad by a shrink wrap 18 (FIG. 3). In the invention, this shrink wrap is cut simultaneously with the described portion 20 or 21 or 23 of the particular projection 10 or 11. The advantage therein is that the packaged unit is held together while being cut as a whole.

Although a preferred embodiment of the invention has been specifically illustrated and described herein, it is to be understood that minor variations may be made in the apparatus without departing from the spirit and scope of the invention, as defined by the appended claims.

We claim:

1. A method of insulating buildings which include a plurality of support members with adjacent support members being spaced a predetermined maximum distance from each other comprising the steps of:

a) providing a plurality of stacked insulation panels with each insulation panel being formed by a panel of mineral wool insulation material having opposite longitudinal edges spaced a predetermined distance from each other at least equal to the predetermined maximum distance between the adjacent support members and a vapour barrier sheet carried by each insulation material panel with opposite longitudinal edges being folded upon an exterior surface of a central portion of each vapour barrier sheet and being directed in opposing relationship toward each other thereby defining exposed opposite projecting longitudinal edge portions of each insulation material panel with the folded distance being sufficient for the subsequently unfolded vapour barrier sheet longitudinal edges to project beyond the insulation material panel longitudinal edges, b) enclosing the stacked insulation panels in a wrap, and c) substantially simultaneously longitudinally severing the wrap and at least one of the longitudinal edge portions of all of the insulation material panels inward of each of their longitudinal edges a distance which creates a severed edge-to-edge distance corresponding generally to a distance between adjacent support members less than the predetermined maximum distance.

2. The method as defined in claim 1 wherein the stacked insulating panels and vapour barrier sheets have a common longitudinal axis, and each vapour barrier sheet longitudinal edge being spaced substantially the same distance from the common longitudinal axis.

3. The method as defined in claim 1 wherein the severing step is performed upon the wrap and both longitudinal edge portions of all insulation material panels.

4. The method as defined in claim 1 wherein the severing step is performed by a single cut.

5. The method as defined in claim 1 wherein each vapour barrier sheet is bonded to an associated insulation material panel.

6. The method as defined in claim 1 wherein each vapour barrier sheet is bonded only to an associated insulation material panel.

7. The method as defined in claim 1 wherein each vapour barrier sheet is a bonded multi-ply sheet of Kraft paper and aluminum foil.

8. The method as defined in claim 1 wherein each vapour barrier sheet is a bonded multi-ply sheet of plastic netting and aluminum foil.

9. The method as defined in claim 1 wherein at least one longitudinal edge of each vapour barrier sheet carries a reinforcing tape.

10. The method as defined in claim 1 wherein at least one longitudinal edge of each vapour barrier sheet carries an adhesive tape covered by a removable cover foil.

11. The method as defined in claim 1 including the step of again folding each vapour barrier sheet longitudinal edge to direct the same away from each other prior to performing the severing step.

12. A method of insulating buildings which include a plurality of support members with adjacent support members being spaced a predetermined maximum distance from each other comprising the steps of:

a) providing an insulating roll formed by an insulation strip of mineral wool insulation material having opposite longitudinal edges spaced a predetermined distance from each other at least equal to the predetermined maximum distance between the adjacent support members and a vapour barrier sheet carried by the insulation material strip with opposite longitudinal edges of the vapour barrier sheet being folded upon an exterior surface of a central portion of the vapour barrier sheet and being directed in opposing relationship toward each other thereby defining exposed opposite projecting longitudinal edge portions of the insulation material strip with the folded distance being sufficient for the subsequently unfolded vapour barrier sheet longitudinal edges to project beyond the insulation material strip longitudinal edges, b) enclosing the insulating roll in a wrap, and c) substantially simultaneously longitudinally severing the wrap and at least one of the longitudinal edge portions of the insulation material strip inward of its longitudinal edge a distance which creates a severed edge-to-edge distance corresponding generally to a distance between adjacent support members less than the predetermined maximum distance.

13. The method as defined in claim 12 wherein the insulating material strip and vapour barrier sheet have a common longitudinal axis, and the vapour barrier sheet longitudinal edges being spaced substantially the same distance from the common longitudinal axis.

14. The method as defined in claim 12 wherein the severing step is performed upon the wrap and both longitudinal edge portions of the insulation strip.

15. The method as defined in claim 12 wherein the severing step is performed by a single cut.

16. The method as defined in claim 12 wherein the vapour barrier sheet is bonded to the associated insulation material strip.

17. The method as defined in claim 12 wherein the vapour barrier sheet is bonded only to the associated insulation material strip.

18. The method as defined in claim 12 wherein the vapour barrier sheet is a bonded multi-ply sheet of Kraft paper and aluminum foil.

19. The method as defined in claim 12 wherein the vapour barrier sheet is a bonded multi-ply sheet of plastic netting and aluminum foil.

20. the method as defined in claim 12 wherein at least one longitudinal edge of the vapour barrier sheet carries a reinforcing tape.

21. The method as defined in claim 12 wherein at least one longitudinal edge of the vapour barrier sheet carries an adhesive tape covered by a removable cover foil.

22. The method as defined in claim 12 including the step of again folding each vapour barrier sheet longitudinal edge to direct the same away from each other prior to performing the severing step.

* * * * *